United States Patent [19]

Carbonero

[11] 3,945,641

[45] Mar. 23, 1976

[54] NET AND PADDLE BALL GAME APPARATUS

[76] Inventor: Fred L. Carbonero, 1623 Kingsmere, Rochester, Mich. 48063

[22] Filed: Dec. 12, 1974

[21] Appl. No.: 532,044

[52] U.S. Cl. ..... 273/95 R; 273/30; 273/29 BC

[51] Int. Cl.[2] ..... A63B 71/02

[58] Field of Search..... 273/29 R, 29 BC, 30, 95 R, 273/1 R, 127 R, 127 B, 127 C; 256/32, 37, 39, 64, 68, 73

[56] References Cited

UNITED STATES PATENTS

| | | | |
|---|---|---|---|
| 2,051,476 | 8/1936 | Grant | 273/30 |
| 2,163,456 | 6/1939 | Youngberg | 273/30 |
| 2,769,636 | 11/1956 | Finestone | 273/30 |

*Primary Examiner*—Richard C. Pinkham
*Assistant Examiner*—T. Brown
*Attorney, Agent, or Firm*—Whittemore, Hulbert & Belknap

[57] ABSTRACT

The game apparatus is adapted for either playing a game similar to ping pong or a game similar to badminton. The apparatus includes a pair of base elements having openings therein to receive the free ends of a resilient plastic rod. The rod is flexed into an arch shape with the ends inserted in the openings in the base elements. A ping pong net is stretched between the lower ends of the rod. The apparatus may be used by setting it on a hard floor whereupon game participants, each of whom is provided with a paddle, hit a ping pong ball back and forth underneath the arch. Alternately, the apparatus may be set higher by use, for example, of chairs. This provides a setting for playing a game similar to badminton in which the bird is hit back and forth through the arch.

5 Claims, 4 Drawing Figures

NET AND PADDLE BALL GAME APPARATUS

BACKGROUND OF THE INVENTION

It is a particular problem in the limited space available in, for example, school gymnasiums, home basements, and the like, to provide for recreational activities involving hitting a moving object such as a ping pong ball or badminton bird. Conventional ping pong tables are permanent structures and therefore permanently take up space which is desirably used for a variety of purposes. For example, it is desirable in a school gymnasium to use floor space for various activities such as basketball, calethetics, dancing, and the like activities requiring a relatively large floor space. To permit this, game apparatus used for other activities should be easily removable when not in use. Similarly, the head room available in a home basement normally prevents playing of games such as badminton which require a relatively high ceiling, and it is also desirable to have basement game apparatus be removable.

The present invention provides a game apparatus capable of use in connection with a game similar to badminton or a game similar to ping pong. When used for badminton, the game may be played even in a home basement having a relatively low ceiling because the maximum upward movements of the bird is restricted by a frame formed by the apparatus. The apparatus may also be used to play a ping pong-like game on a hard floor.

The apparatus may be easily and quickly dismantled and stored as a compact unit thus permitting use of the available floor space for other purposes as desired. The apparatus is also inexpensive and of durable construction.

SUMMARY OF THE INVENTION

Game apparatus is provided. The apparatus includes a base structure for reception on a generally horizontal support structure. An elongated flexible rod is provided. The base structure has spaced apart opening means therein to receive the free ends of the elongated rod. The elongated rod is flexed into an arch shape with the free ends thereof being removably received in said openings. A net is stretched between the ends of the rod adjacent the base structure.

Figure 1:
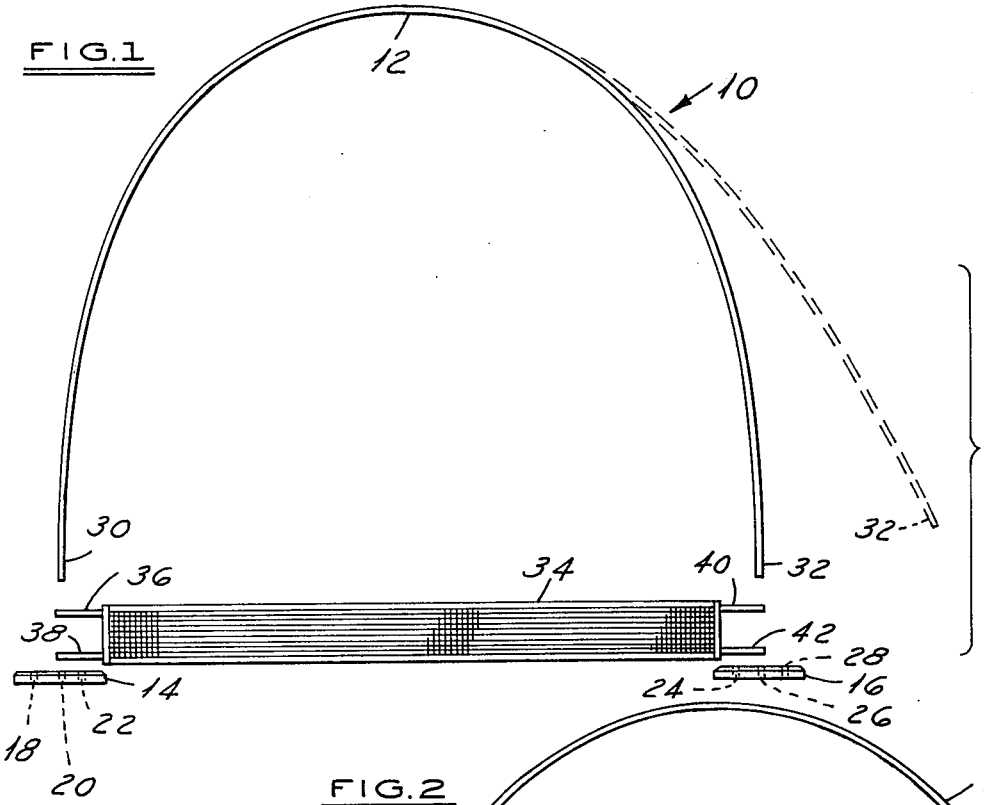
FIG. 1 is a front elevational view of the game apparatus is disassembled condition illustrating one embodiment of the present invention.

Referring first to FIG. 1, the game apparatus 10 includes a long flexible plastic rod 12, a pair of generally rectangular base elements 14, 16 made of, for example, wood. Each base element 14, 16 has three spaced apart recesses 18, 20, 22, 24, 26 and 28 to receive the free ends 30, 32 of the rod 12. The apparatus is completed by an elongated relatively narrow net 34 having a pair of loops 36, 38, 40, 42 at each end thereof. The net 34 is similar to the standard ping pong net.

Figure 2:
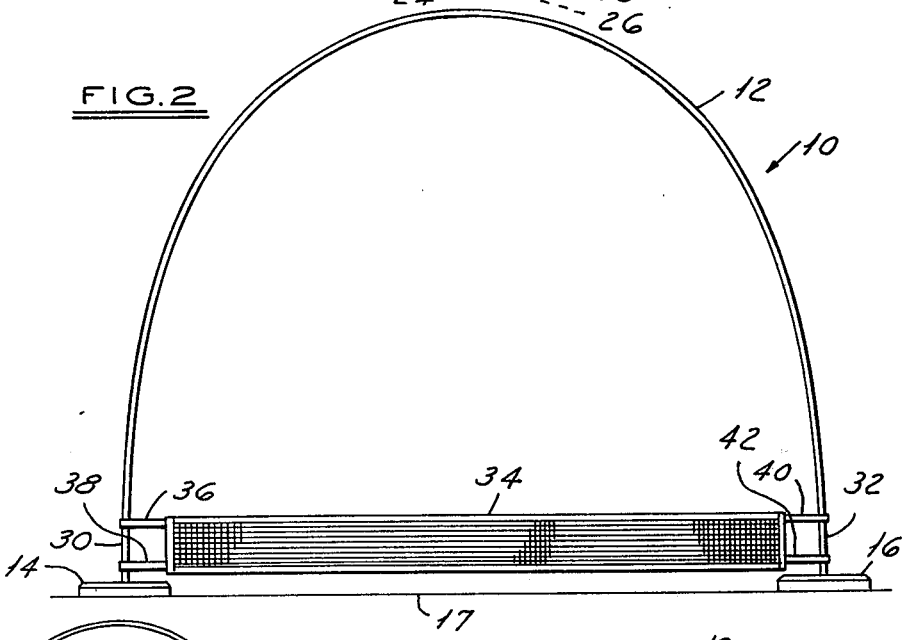
FIG. 2 is a front elevational view of the game apparatus of FIG. 1 shown in assembled condition.

The elements of FIG. 1 are assembleable into the apparatus illustrated in FIG. 2. In assembling the apparatus, the base elements 14, 16 are conveniently laid in spaced apart condition on, for example, a floor 17. One end 30 of the rod 12 is then inserted through the loops 36, 38 and into one of the recesses 18, 20, 22. The other end 32 of the rod is then flexed from the dotted line position illustrated in FIG. 1 to the solid line position and inserted through the loops 40, 42 and into one of the recesses 24, 26, 28. This results in the assembled apparatus shown in FIG. 2.

The provision of three recesses in each of the base elements 14, 16 permits some variation in tautness of the net 34 in a situation where spacing apart of the base elements 14, 16 is restricted. The nets may vary somewhat in length depending upon manufacturing tolerances. Additionally, after usage, the net may stretch. Thus, initially, when the net is new, the innermost recesses 22, 24 may be used with the net being taut. As the net is stretched in use, the outermost recesses may then be deployed to maintain the net in the taut condition desired.

Figure 4:
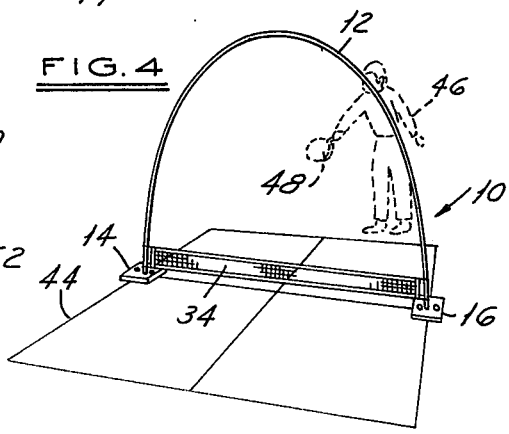
FIG. 4 is a view of the game apparatus of FIG. 2 in assembled condition set on a hard surface floor for use of the apparatus in playing a game similar to ping pong.

Referring now to FIG. 4, one method of employing the game apparatus is illustrated. In FIG. 4, the game apparatus 10 is set on a hard surface, either a cement surface as in a home basement or a hardwood floor as in a school gymnasium. The floor may be marked with indicia 44 as shown to simulate the surface of a ping pong table. The participant 46 on one side of the net is provided with a bat 48. The bat 48 may be a conventional ping pong bat. Alternately, it may be fabricated as a as a relatively large circle out of a foamed plastic material to limit how hard the ping pong ball may be hit and thereby automatically provide a means for some restraint on participants to maintain the ball in place. As will be appreciated, a participant is also on the other side of the net to return the ball. Four players may also be paired into two teams to play doubles as is common in regular ping pong.

Figure 3:
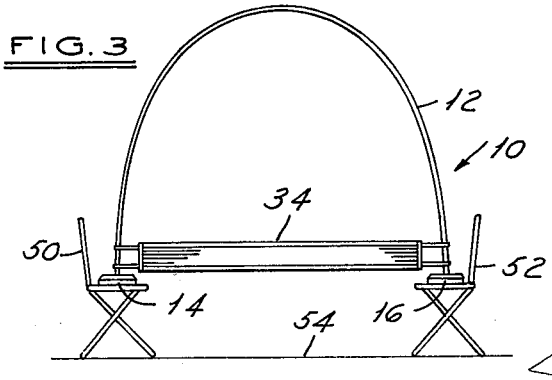
FIG. 3 is a view illustrating the assembled apparatus of FIG. 2 mounted on a pair of chairs for playing a game similar to badminton.

FIG. 3 illustrates a convenient method for employing the game apparatus 10 to play a game similar to badminton. The game apparatus is set on two chairs 50, 52 to elevate it from the ground level 54. Participants on either side of the net are provided with bats as in FIG. 4 and hit a badminton bird back and forth through the arch formed by the rod 12 as in regular badminton. One difference is that the bird must be hit in the arch defined by the rod which thereby limits the upward travel of the bird. Again, floor indicia may be provided as in FIG. 4.

What I claim in my invention is:

1. A game apparatus comprising a pair of base members, an elongated resilient rod member and an elongated net; means attaching each of said base members to opposite ends of said rod member; said rod being flexed into a U-shaped arch configuration; said net being stretched between the ends of said rod and having means at each of its ends attached to an end of said rod adjacent one of said base members to hold said rod in said arch configuration; said rod and said net defining an opening therebetween; said base members being placed on a support surface, said net and said rod being supported by said base members such that said rod is held in an inverted U position and said rod and said net are coplanar in a substantially vertical plane, said opening being positioned to allow a ball to pass therethrough.

2. The game apparatus as defined in claim 1 wherein said means attaching each base member to said rod is at least one opening in each base member telescopically receiving an end of said rod.

3. The game apparatus as defined in claim 1 wherein said means at each end of said net attached to said rod is at least one loop for reception of the ends of said rods.

4. The game apparatus as defined in claim 1 wherein said support surface for said base members is at an elevation higher than the surface on which players using said device stand.

5. The game device as defined in claim 1 wherein said support surface for said base members is coplanar with the surface on which players using said device stand.

* * * * *